US009440140B1

(12) United States Patent
Alqattan

(10) Patent No.: US 9,440,140 B1
(45) Date of Patent: Sep. 13, 2016

(54) WAR GAME USING CARDS AND DICE

(71) Applicant: Omar Khaled Alqattan, Kuwait (KW)

(72) Inventor: Omar Khaled Alqattan, Kuwait (KW)

( * ) Notice: Subject to any disclaimer, the term of this patent is extended or adjusted under 35 U.S.C. 154(b) by 0 days.

(21) Appl. No.: 14/944,204

(22) Filed: Nov. 17, 2015

(51) Int. Cl.
*G06F 17/00* (2006.01)
*A63F 1/04* (2006.01)
*A63F 13/80* (2014.01)

(52) U.S. Cl.
CPC ..... *A63F 1/04* (2013.01); *A63F 13/80* (2014.09); *A63F 2001/0483* (2013.01)

(58) Field of Classification Search
USPC ..... 463/16–25
See application file for complete search history.

(56) References Cited

U.S. PATENT DOCUMENTS

| | | | | |
|---|---|---|---|---|
| 5,112,059 | A | 5/1992 | Mundle et al. | |
| 5,465,973 | A | 11/1995 | Anderson | |
| 5,879,005 | A | 3/1999 | Baca | |
| 6,254,099 | B1 | 7/2001 | Pederson | |
| 6,561,513 | B1 | 5/2003 | DeGeorge | |
| 6,964,417 | B2 | 11/2005 | Bodish | |
| 7,118,107 | B2 * | 10/2006 | Niedner | A63F 1/04 273/236 |
| 7,371,165 | B2 * | 5/2008 | Reizei | A63F 13/10 273/244 |
| 8,469,361 | B2 * | 6/2013 | Gress | A63F 9/00 273/243 |
| 8,590,897 | B1 * | 11/2013 | McCarey | A63F 1/04 273/255 |

FOREIGN PATENT DOCUMENTS

| | | |
|---|---|---|
| GB | 2 203 355 A | 10/1988 |
| GB | 2 206 497 A | 1/1989 |

* cited by examiner

*Primary Examiner* — Ronald Laneau
(74) *Attorney, Agent, or Firm* — Richard C. Litman

(57) ABSTRACT

The war game using cards and dice includes a plurality of game cards having a distinct first subset of game cards including a plurality of Soldier game cards, a plurality of Base game cards, and a plurality of Supply game cards, a distinct second subset of game cards including a plurality of Area game cards, a distinct third subset of game cards including a plurality of Action game cards, and at least one dice. The goal of the game is to acquire two sets of "Area" cards. Each Area card is identified by an Area name, a corresponding Area flag, a numerical value, and a group area designation as discussed further below. A "set" of Area cards includes three Area cards having the same area name and/or flag. The game can further require that the two sets be in the same group area.

10 Claims, 8 Drawing Sheets

WAR GAME USING CARDS AND DICE

BACKGROUND OF THE INVENTION

1. Field of the Invention

The present invention relates to games, and particularly to a game of war using cards and dice.

2. Description of the Related Art

Interactive card games and board games are considered by many to be an enjoyable way to interact with others. A number of card games and board games have been developed over the years dealing with mystery, chance, artistic skill, knowledge, and memory.

Card games, in particular, are an ideal source of entertainment when individuals are traveling, as cards are easily transportable. Generally, however, many card games are restricted to those involving the standard deck of fifty-two cards. Accordingly, there is a need for new attractions and features in the card games market.

Thus, a game of war using cards and dice solving the aforementioned problems is desired.

SUMMARY OF THE INVENTION

The war game using cards and dice includes a plurality of game cards having a distinct first subset of game cards including a plurality of Soldier game cards, a plurality of Base game cards, and a plurality of Supply game cards, a distinct second subset of game cards including a plurality of Area game cards, a distinct third subset of game cards including a plurality of Action game cards, and one or more dice. The plurality of Soldier game cards and Base game cards can be used together with Area game cards to provide a player's attack force value. The goal of the game is for a player to acquire two sets of "Area" cards. A player must accumulate sufficient attack force value before acquiring an opponent's Area cards. Each Area card is identified by an Area name, a corresponding Area flag, a numerical value, and a group area designation as discussed further below. A "set" of Area cards includes three Area cards having the same area name and/or flag. The game can further require that the two sets be in the same group area.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
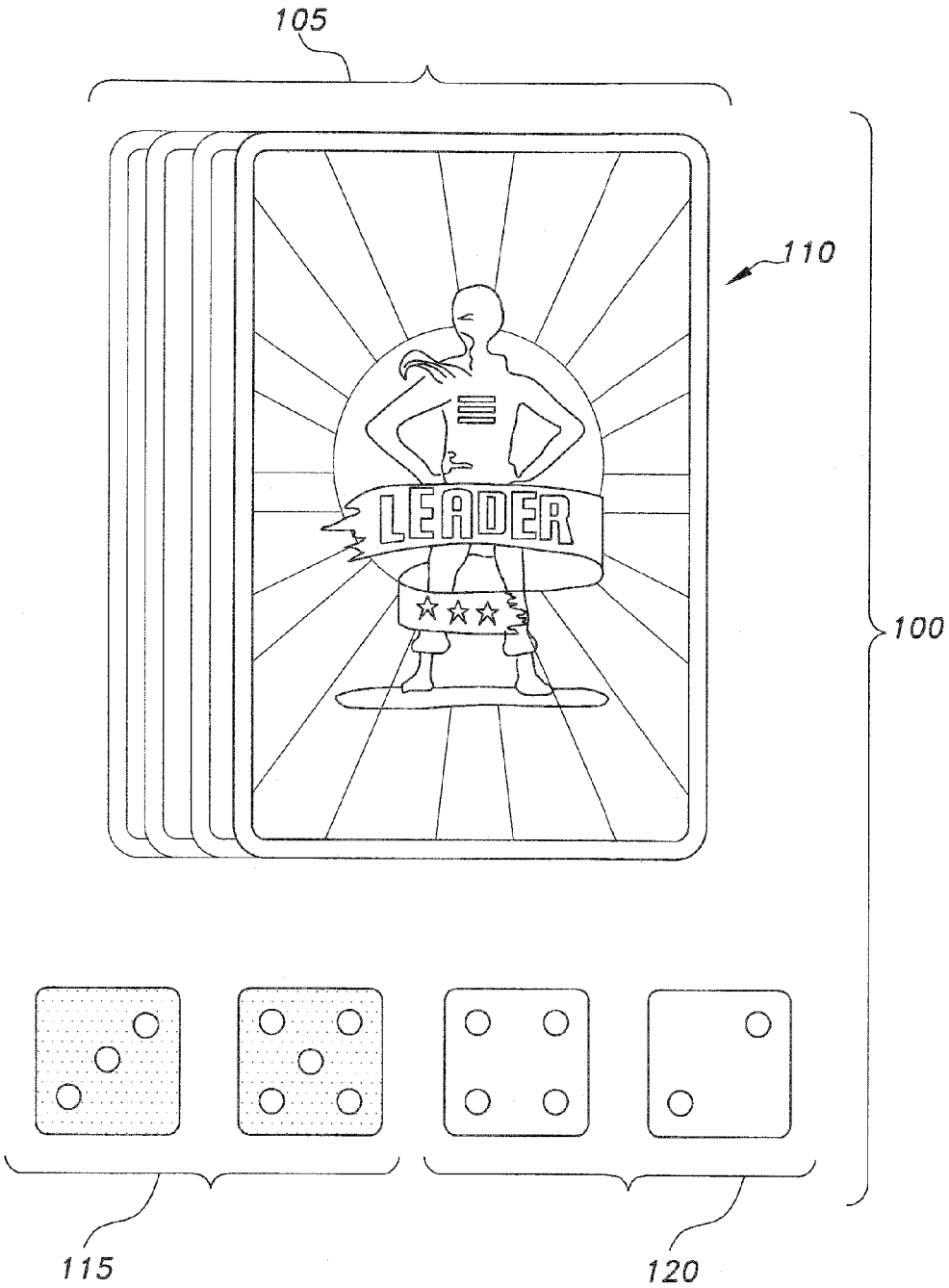
FIG. 1 is an environmental view of various components used in a war game using cards and dice, according to the present invention.

Referring to FIGS. 1 through 4B, a war game 100 is generally illustrated. The game of war 100 can include a plurality of war game cards 100 and at least one dice. The game 100 can be played by up to six players, with the goal of the game being to acquire two sets of "Area" cards, as described in detail below. Each Area card is identified by an Area name 240, such as "GOLF", a corresponding Area flag 245, a numerical value 210, and a group area designation 310 as discussed further below. A "set" of Area cards includes three Area cards having the same area name and/or flag. The game can further require that the two sets be in the same group area, i.e., have the same group area designation.

The plurality of game cards 110 can include a distinct first subset of game cards 200, a distinct second subset of game cards 300, a distinct third subset of game cards 400, at least one attacker dice, the attacker dice having a plurality of faces, each of the attacker dice faces having a distinct identifiable indicia displayed thereon, and at least one defender dice, the defender dice having a plurality of faces, each of the defender dice faces having a distinct identifiable indicia displayed thereon. The distinct identifiable indicia can include different colors, different signs, different symbols, and different numbers. It is to be noted that the game 100 can include instructions, such as fully illustrated instructions.

The at least one attacker dice can include an attacker set 115. The at least one defender dice can include a defender set 120. Each die in the attacker set 115 and each die in the defender set 120 can have six different faces, each face representing a different number, such as numbers one through six. For example, each face can have a different number of dimples representing a specific number. Further, each of the attacker die 115 can have a first color and each of the defender die 120 can have a color different from the first color. For example, each die in the attacker set 115 can be red and each die in the defender set 120 can be white.

It is to be noted that each of the plurality of game cards 110, preferably one-hundred and forty game cards 110, can have two faces, including a front face and a back face. The front face can include a representation and/or indicia essential for playing the game 100, while the back face includes a non-essential representation and/or indicia. For example, the back face of each of the plurality of game cards 110 can include the same logo, such as the "LEADER" logo as shown, or any other suitable indicia.

The distinct first subset of game cards 200, preferably numbering fifty game cards 110, can include a plurality of Soldier game cards 205, a plurality of Base game cards 215, and a plurality of Supply game cards 225. Each of the plurality of Soldier game cards 205 can have a first set of distinct identifiable indicia, such as a numerical value 210, such as 1,000, 5,000, or 10,000, displayed thereon. Each number 210 displayed on one of the plurality of Soldier game cards 205 can represent a value of that Soldier game card 205 in terms of soldiers, such as 1,000 Soldiers, 5,000

Soldiers, and 10,000 Soldiers. Each of the plurality of Base game cards 215 can have a second set of distinct identifiable indicia associated with an armed force, such as a tank 220, an airplane 230, or a boat (not shown), displayed thereon. The tank 220, airplane 230, or boat (not shown), represent a different force, such as land forces, air forces, and naval forces, respectively. Further, each Supply game card 225, can have a third set of distinct identifiable indicia, such as an Area name 240, such as "GOLF", and the corresponding Area flag 245 displayed thereon. It is to be noted that each of the plurality of Supply game cards 225 can be constrained by a particular Area. In other words, each of the plurality of Supply game cards 225 can only be used for certain Area(s) in the game 100 represented by the Area name 240 and the corresponding Area flag 245 on each of the plurality of Supply game cards 225.

Figure 2A:
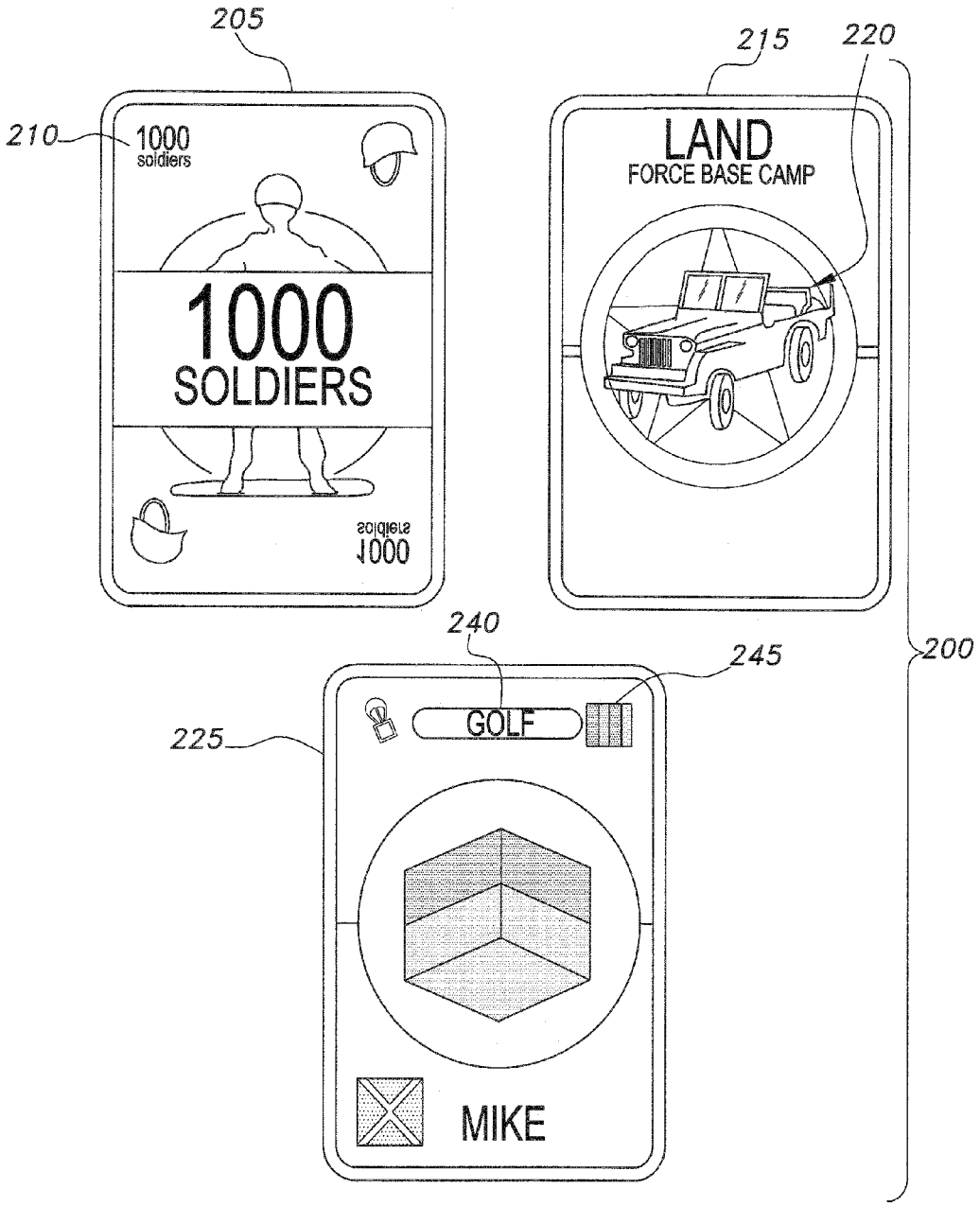
FIG. 2A is a top view of a front side of a Soldier game card, a Base game card, and a Supply game card, according to the present invention.
Figure 2B:
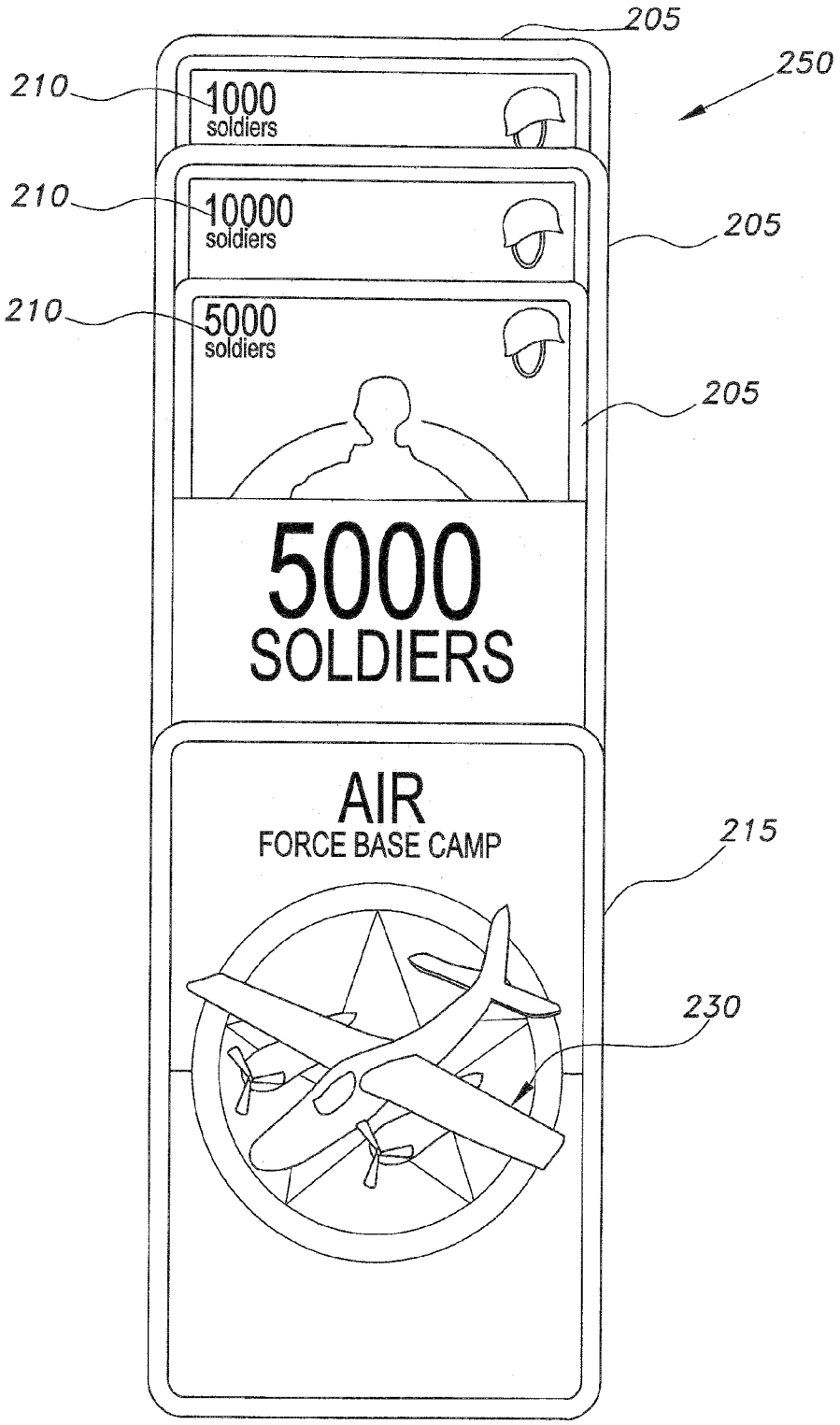
FIG. 2B is a top view of a stack of cards including Soldier game cards and Base game cards, according to the present invention.

It is to be noted that the Soldier game cards 205 and the Base game cards 215 can be arranged in a Soldier game card stack 250, as illustrated in FIG. 2B. The Soldier game cards 205 and the Base game cards 215 can represent a player's strength, as well as arsenal, which can determine not only which other player s/he can attack, but also which player(s) can attack him/her, since a player can only attack another player whose strength is less than or equal to a strength of the attacking player.

Each of the plurality of Supply game cards 225, on the other hand, such as a Supply Any game card and Double Supply game card, can be used to take Soldier game cards 205 and Base game cards 215 away from another player or from all other players, depending on the instruction on the respective Supply game card 225. It is to be noted that a Double Supply game card can be used in conjunction with a Supply Any game card, so as to double the amount of Soldier game cards 205 or Base game cards 215 that can be taken from another player. Once a player has played his/her Supply game card 225 and taken the Soldier game cards 205 and/or the Base game cards 215 from the other player(s), the Soldier game cards 205 and the Base game cards 215 can be arranged in the respective player's Soldier game card stack 250 so as to increase that player's strength, as well as arsenal.

The distinct second subset of game cards 300, preferably numbering thirty game cards, can include a plurality of Area game cards 300. Each of the plurality of Area game cards 300 can include the third set of distinct identifiable indicia, such as the Area name 240, such as "GOLF", and the corresponding Area flag 245 displayed thereon so as to represent an Area in the game 100, and a fourth set of distinct identifiable indicia, such as a group area 310, a plurality of symbols 320 representing potential targets, a first supply value 325, such as for supplies for a particular Area, and a second supply value 330, such as a supply value in terms of Soldiers for a particular Area. For example, a subset of thirty Area cards can represent 10 different geographical regions or areas, so that each Area name 240 can be displayed on three identical Area game cards 300. Further, each Area game card 300 can also include the numerical value 210 corresponding to a soldier value. It is to be noted that each of the plurality of Area game cards 300 can only attack specific Areas, such as those Areas represented by the plurality of symbols 320 on each of the plurality of Area game cards 300. In other words, an attacker can only acquire those cards from another player which are associated with areas authorized for attack represented by the plurality of symbols 320 on each of the Area game cards 300 that are in the attacker's possession. Accordingly, the plurality of symbols 320 on each of the plurality of Area game cards 300 represents that Area game card's border limits.

Each of the Soldier game cards 205 can represent 1,000 soldiers, 5,000 soldiers, or 10,000 soldiers, and can be placed in a stack on one or more of the plurality of Area game cards 300 to represent increased Area strength, as well as arsenal value. Each of the plurality of Base game cards 215 can also be placed in a stack on one or more of the plurality of Area game cards 300 to represent increased Area strength, as well as arsenal value. The higher the Area's strength and arsenal value, the stronger the force needed to attack that Area.

Figure 3A:
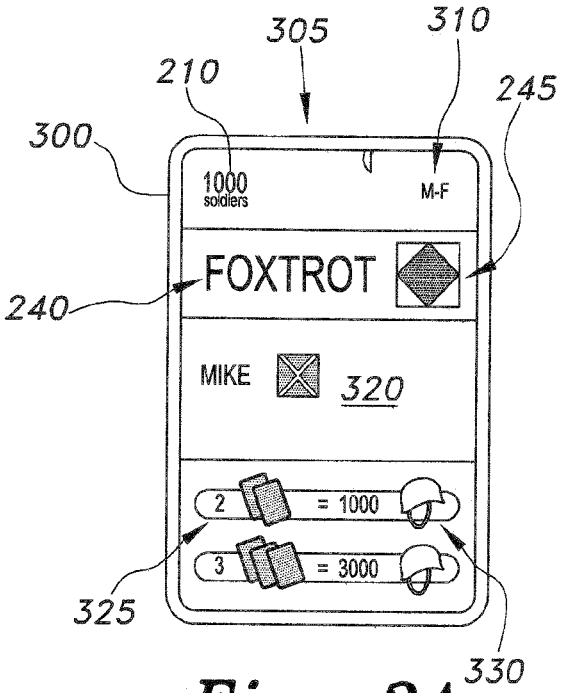
FIG. 3A illustrates a single Area game card, according to the present invention.
Figure 3B:
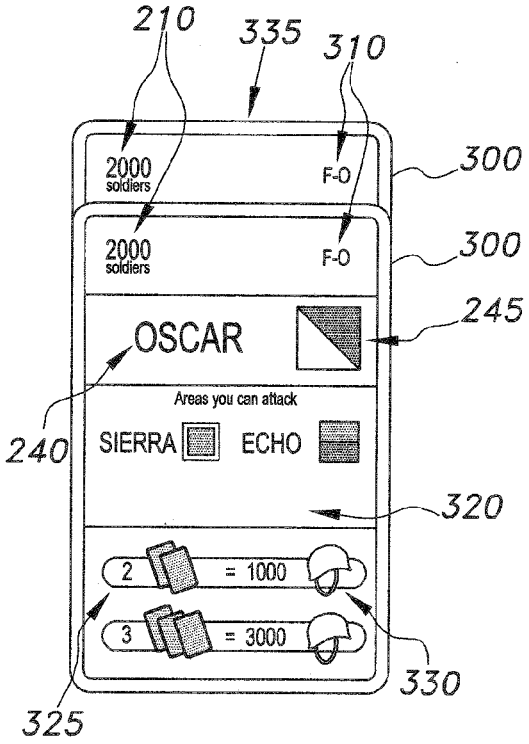
FIG. 3B illustrates an incomplete set of Area game cards, according to the present invention.
Figure 3C:
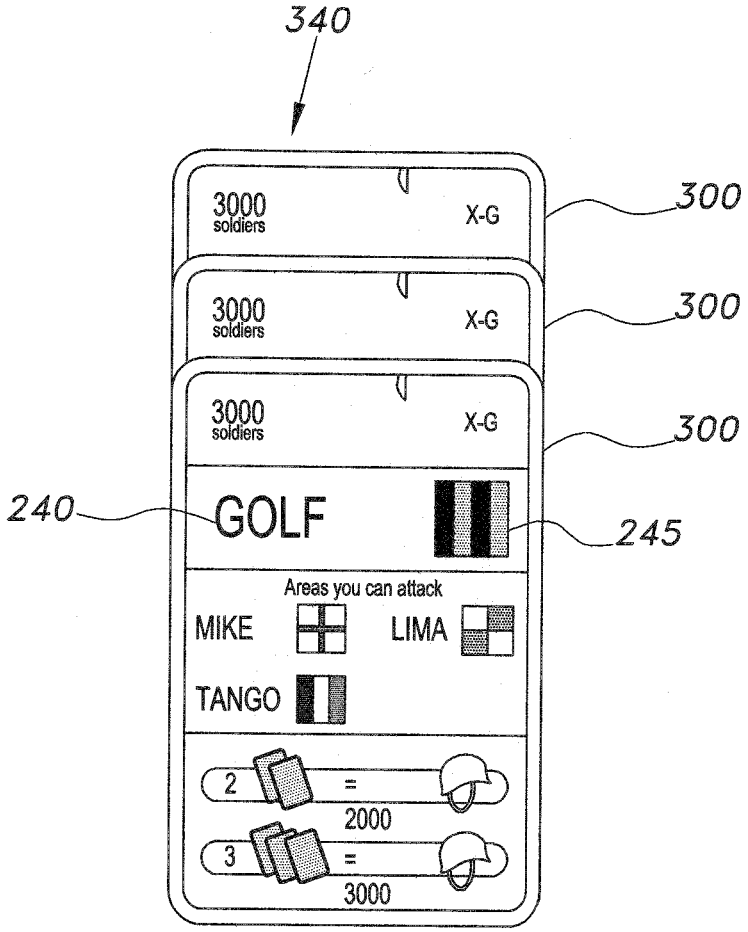
FIG. 3C illustrates a full set of Area game cards, according to the present invention.
Figure 3D:
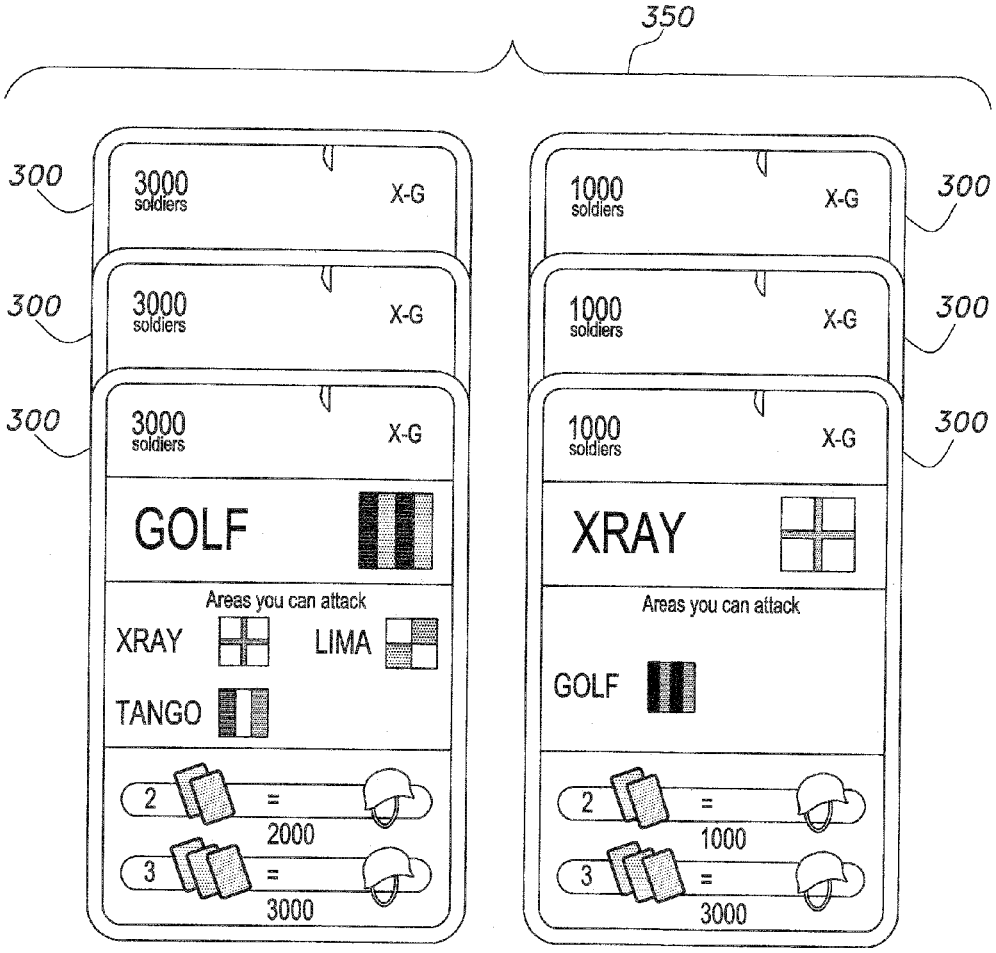
FIG. 3D illustrates a group of Area game cards, according to the present invention.
Figure 4A:
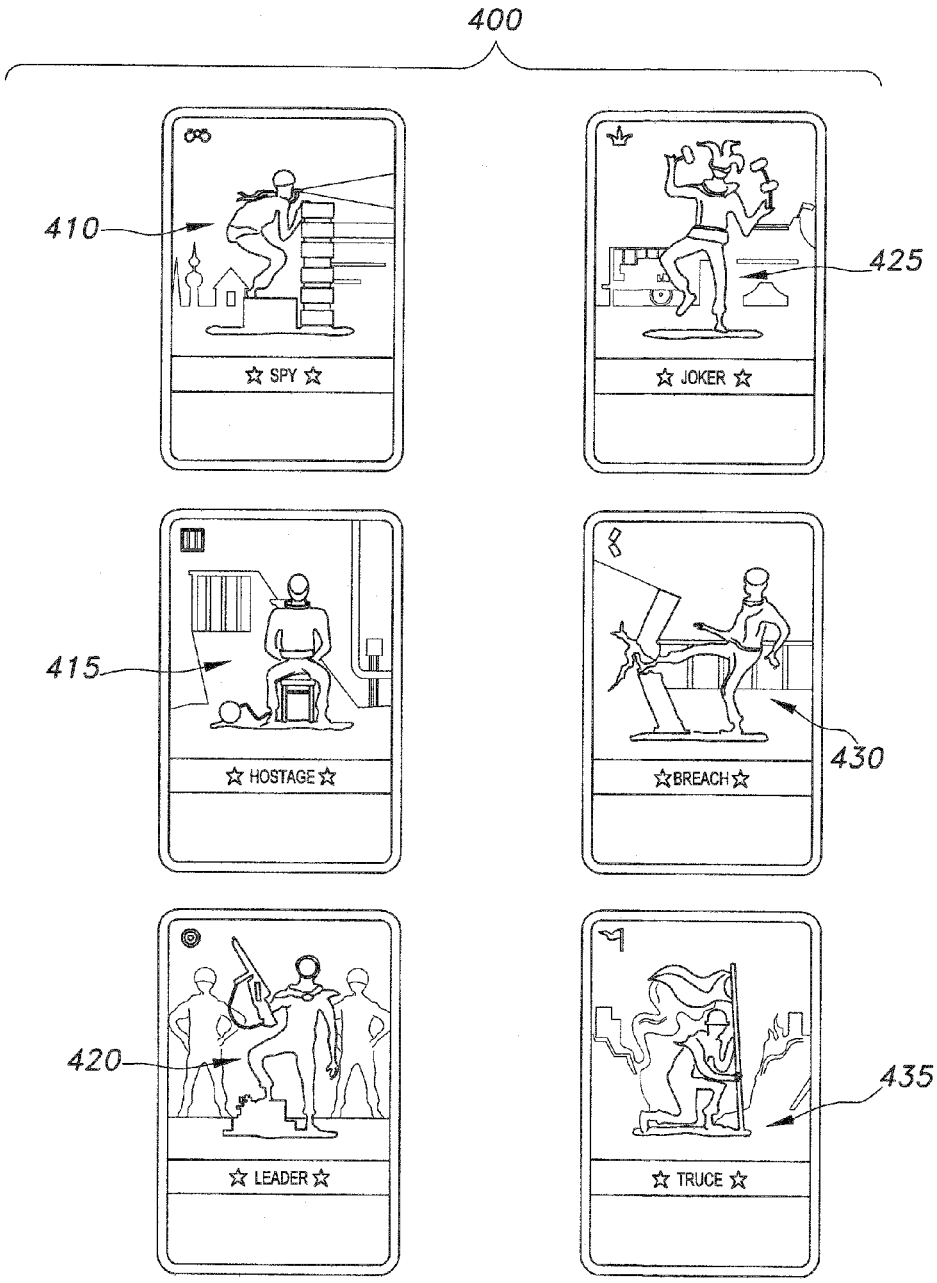
FIG. 4A illustrates a partial set of Action game cards, according the present invention, showing samples of general categories used in the game.
Figure 4B:
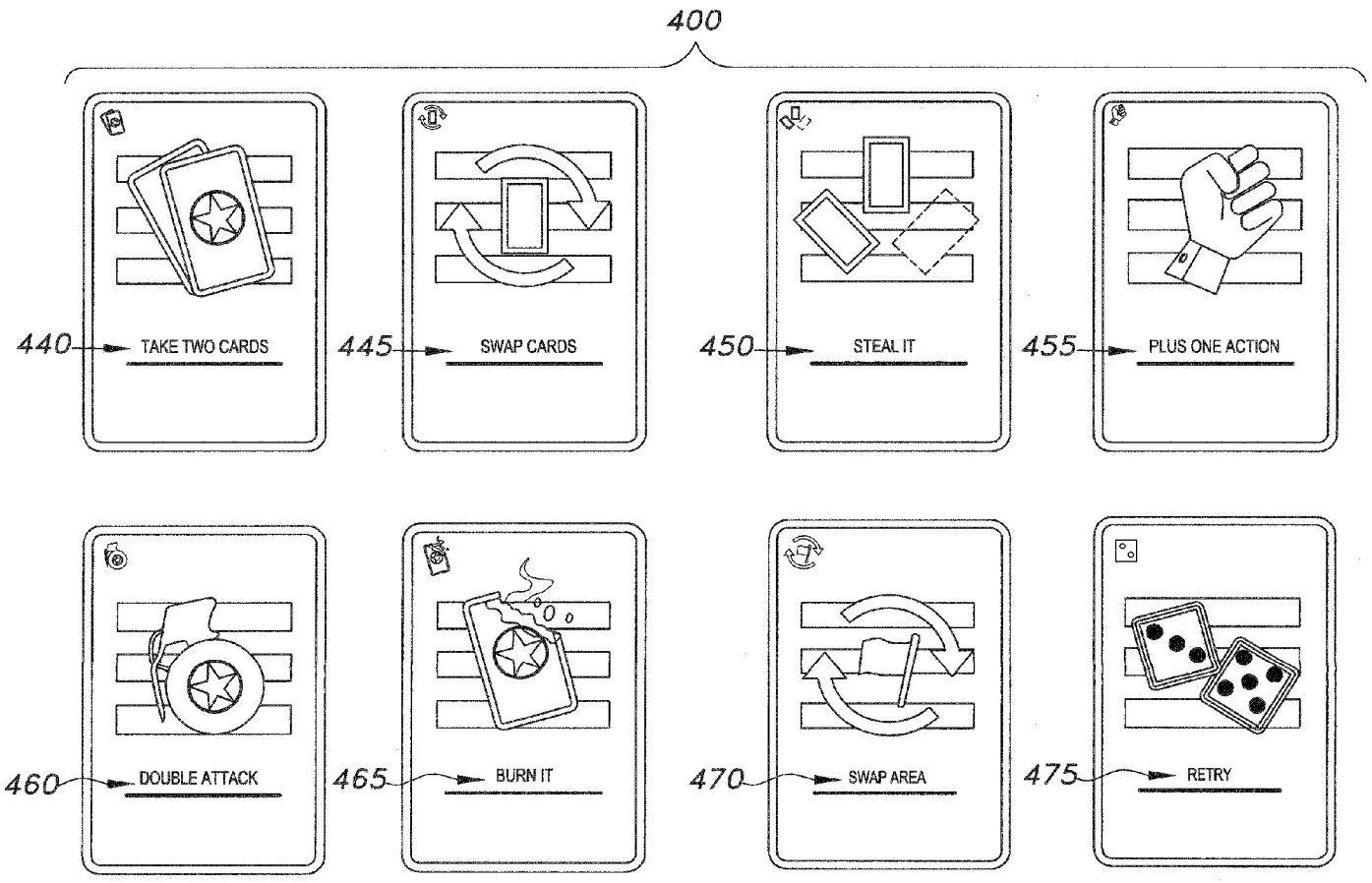
FIG. 4B illustrates another partial set of Action game cards, according the present invention, showing samples of general categories used in the game.

Each of the plurality of Area game cards 300 representing the same area can be arranged together as a single Area 305. FIG. 3A depicts one Area game card 300. FIG. 3B depicts an incomplete set 335 of Area game cards 300, i.e., two Area game cards 300 having the same Area name 240, the same Area flag 245, and the same color. FIG. 3C depicts a full set 340 of Area game cards 300, i.e., three Area game cards 300 having the same Area name 240, the same Area flag 245, and the same color. It is to be noted that two full sets 340 of Area game cards 300 can form a group 350 (FIG. 3D.

The winner of the game 100 is the first player to collect a predetermined number of groups 350, such as one or more groups 350. It is to be noted that the number of groups 350 needed to win the game can vary depending on the number of players, as well as the desired speed of play. For example, if the game 100 is played by two to four players, the winner can be the first player to acquire two groups 350. However, if the game 100 is played by four to six players, the winner can be the first player to acquire one group 350.

The distinct third subset of game cards 400, preferably numbering sixty game cards 110, can include a plurality of Action game cards 400, each Action game card 400 having a fifth set of distinct identifiable indicia displayed thereon which represents an action that a player can take when the respective Action game card 400 is played, such as by disposing the Action game card 400 in front of the other players. The fifth set of distinct identifiable indicia can include figures, such as a spy FIG. 410 that can allow the player to select another player and view their cards, a "hostage" FIG. 415 that can allow the player to select another player and prevent him/her from playing his/her turn, a "leader" FIG. 420 that can allow a player to select any action that s/he wishes to take e.g. Wild Card, a "joker" FIG. 425 that can be used as an Area game card 300 of the player's choice (e.g. if, for example, the player has an incomplete set 335 of Area game cards 300 the Action game card 400 having the joker FIG. 425 can be used to complete the set so as to form a full set 340), a "breach" FIG. 430 that can allow the player to attack any Area game card 300 without border limits, or a "truce" FIG. 435 that can allow a player to be completely immune from attack or from an Action game card 400 from any other player for one full round.

Further, the figures can also include a "no chance" figure, which does not count as one of the three moves, but can allow the player to cancel any Action game card 400 played against him/her, such as in an attack, an "invasion" figure that can allow the player to take one full set 340 from any other player of his/her choosing and does not require the player to give anything in return, a "thief" figure that can allow the player to steal one Area game card 300 from any other player whether it is a single Area 305 or part of a set, such as an incomplete set 335 or a full set 340, a "someone else" figure that can be played in response to a Supply game card 225, such as to allow the player to choose another player to pay the supplies instead of him/her, a "you are stuck" figure that can allow the player to swap a full set 340 with another player, and a "prisoner's" figure that can allow the player to collect 2000 Soldiers from all of the other players in the game 100. It is to be noted that if a player runs out of Soldiers s/he can pay with Base game cards 215 and/or Area game cards 300.

The fifth set of distinct identifiable indicia can include instructions, such as "Take Two Cards" 440 that can allow the player to take two cards from the withdrawal deck 105, "Swap Cards" 445 that can allow the player to swap all of the game cards 110 in his/her hand with the game cards 110 in another player's hand, "Steal It" 450 that can allow the player to take one game card 110 at random from another player, "Plus One Action" 455 that can give the player a move in addition to the three moves in his/her turn, "Double Attack" 460 that can allow the player to attack the same player twice in the same turn, "Burn It" 465 that can allow the player to discard a game card 110 at random from another player's hand, "Swap Area" 470 that can allow the player to swap one Area game card 300 with another Area game card 300 from another player, and "Retry" 475 that can allow the player to have another try at throwing his/her dice.

The instructions can also include "last card" that can allow the player to collect the last game card 110 thrown in the center of the game 100, but not the player's own game card 110, "deploy" that can allow the player to move Solider game cards 110 from one Area to another or from a column to an Area, and "Ambush" that can allow the play to take all the cards in a Soldier game card stack 250 of any player.

It must be noted that Soldier game cards 205 and/or Base game cards 215 cannot be positioned on top of an. Action game card 400 having the joker FIG. 425 unless the Action game card 400 having the joker FIG. 425 is already on top on an Area game card 300. Further, Action game cards 400 having the joker FIG. 425 cannot be used in attacks, however, if the Area game card 300 having the Action game card 400 including the joker FIG. 425 is taken, then the Action game card 400 having the joker FIG. 425 will also be taken. Action game cards 400 having the thief figure, the invasion figure, the "you are stuck" figure, or the "Swap Area" instruction 470 can take the Action game card 400 having the joker FIG. 425.

Unlike Supply game cards 225, Action game cards 400 are not constrained by Area, which can be denoted by the Area name 240 and the corresponding Area flag 245. When the Action game card 400 having the "Swap Area" 470 instruction is used, only one Area game card 300 can be swapped and any Soldier game card(s) 205 and/or Base game card(s) 215 can remain in place. For example, if a player's Area game card 300 is swapped, any Soldier game card(s) 205 and/or Base game card(s) 215 can be placed in the player's Soldier game card stack 250, since Soldier game card(s) 205 and Base game card(s) 215 cannot be alone, such as without an Area game card 300.

A player can acquire a full set 340 of Area game cards 300 through either the use of Action game cards 400, as described above, and/or by attacking another player, as further described below. A full attack can be carried out on another player's single Area 305, incomplete set 335, or full set 340, as well as on the Soldier game cards 205 and/or the Base game cards 215 of that Area 305. A particular Area 305 can be formed by stacking one or more Area game cards 300 associated with the same area, Soldier game cards 205 and/or Base game cards 225 in a single stack. The Soldier game cards 205 and/or Base game cards 225 add to the strength of the Area 305 in which they are grouped. The A player can suffer a full loss when s/he loses everything in his/her Area, incomplete set 335, or full set 340 including its Soldier game cards 205 and Base game cards 215.

By way of operation, prior to beginning the game 100, the plurality of game cards 110 can be shuffled and arranged in a withdrawing deck 105. Each player can then be given a plurality of game cards 110, desirably five game cards 110, and the remaining game cards 110 can be arranged faced down in the withdrawing deck 105. There are a plurality of ways to determine who begins the game 100. It is preferable that the youngest player being the game 100.

The player designated to start the game 100, can be known as the initiating player. It is to be noted that each player can have a maximum of three moves per turn. Accordingly, the initiating player can initiate the game by selecting a first move from a plurality of moves. The plurality of moves can include playing an Action game card 400, re-arranging Soldier game card(s) 205 or Base game card(s) 215, moving an Area game card 300 from the player's hand onto the playing surface, such as a table (not shown), so as to arrange the Area game cards 300 according to Area name 240, Area flag 245, and color, or attacking another player. Each player can have a maximum of three moves per turn. After the first move is completed, the initiating player can select a second move from the plurality of moves. After the second move is completed, the initiating player can select a third move from the plurality of moves until s/he has finished his/her three moves and competed his/her turn.

It is to be noted that each player can withdraw additional game cards 110, such as two game cards 110, from the withdrawing deck 105 as part of his/her turn. However, the maximum number of game cards 110 in a player's hand at any one given time can be seven game cards 110 after the player finishes his/her turn. In the case where the player is left with more than seven game cards 110 in his/her hand after playing all three moves, an opponent can randomly pick the extra card(s) from the player's hand and dispose of them by placing them back into the withdrawing deck 105. For example, if a player has nine cards in his/her hand after completing his/her three moves, another player can randomly select two game cards 110 and deposit them into the withdrawing deck 105.

As mentioned above, in addition to playing an Action game card 400 against another player, the player can also re-arrange his/her Soldier game card(s) 205 or Base game card(s) 215, such as on top of a single Area 305, an incomplete set 335, or in a full set 340 of Area game cards 300, so as to increase the strength and, in turn, the defense value of an Area, such as the single Area 305, an incomplete set 335, or in a full set 340 of Area game cards 300. Further, re-arranging Soldier game cards 205 or Base game cards 215 also includes forming a Soldier game cards stack 250, as illustrated in FIG. 2B, such as next to the Area game cards.

Although the Area game cards 300 can be kept in the player's hand, the player can move an Area game card 300 from the his/her hand onto the playing surface as one of his/her moves during a turn so as to arrange the Area game card 300 according to Area name 240, Area flag 245, and color, such as in a single Area 305, an incomplete set 335, or to complete a full set 340. It is to be noted that the Area game cards are worthless if they remain in the player's hand. It is to be noted that if a player has no game cards 110 in their hand at the time of their next turn, that player can take up to five game cards 100 from the withdrawing deck 105.

The player can also attack another player during his/her turn. It is to be noted that since attacking counts as one of a player's three moves, s/he can attack up to three different players per turn. However, s/he may not attack the same player twice in the same turn unless the player attacking has the Action game card 300 having the "Double Attack" instruction 460.

During an attack, the player attacking can be designated as an attacker and the player being attacked can be designated as a defender. In order for the attacker to attack the defender, the attacker must first declare war against the defender by identifying the player to be attacked. After the attacker has declared war on the defender, the attacker must select an Area represented by one of the plurality of Area game cards 300 that the attacker wishes to attack. The Area can be a single Area 305, an incomplete set 335, or a full set 340.

After the attacker has declared war on the defender and selected an Area s/he wants to attack, the attacker needs to determine his/her attack force value. The attacker's attack force value is determined by adding up the values of the Soldier game card(s) 205, the Base game card(s) 215, and/or the Area game card(s). It must be noted that the Soldier game card(s) 205, the Base game card(s) 215, and/or the Area game card(s) must be in the same set, such as on a single Area 305, an incomplete set 335, or a full set 340. The higher the attacker's attack force value the greater the number of sets, either single Area 305, incomplete set 335, or full set 340, that he/she can attack. Players can only attack other Areas having an attack force value equal to or less than the attacker's attack force value. For example, the full set 340 can attack another full set 340, an incomplete set 335, or a single Area 305, but the single Area 305 cannot attack the full set 340 or the incomplete set 335. Further, a full set 340 that is part of a group 350 can only be attacked by another full set 340 that is part of a group 350.

Once the attacker has decided which player to attack and has determined his/her attack force value, the attacker can roll the attacker dice 115 to achieve a first numerical value and the defender can roll the defender dice 120 to achieve a second numerical value. It is to be noted that the attacker can roll the attacker dice and the defender can roll the defender dice simultaneously, such as at substantially the same time. The attacker and the defender can then compare the first numerical value and the second numerical value, respectively, to determine a winner. The player who rolls the highest numerical value wins. However, it is to be noted that if the attacker and the defender tie, the attacker loses.

If the attacker wins, the defender must pay the attacker the attack force value that was declared prior to the attack, such as from the single Area 330, the incomplete set 335, or the full set 340 selected by the attacker. If, however, the attacker loses, he/she must surrender the attack force value that was declared at the beginning of the attack. It is to be noted that the loser can pay the winner using their defenses e.g. Soldier game cards 205 and/or Base game cards 215, and the Area game card(s) 300. However, since Area game cards are more strategically valuable, it is recommended that the loser pay with their defenses e.g. Soldier game card(s) 205 and their Base game card(s) 215 first. Further, the losing player must pay the winning player in full even if it means that the losing player is forced to pay more than the losing player should. For example, if the losing player owes the winning player "1,000 Soldiers" but only has a Soldier game card 205 valued at "10,000 soldiers" the losing party will have to hand over the Soldier game card 205 worth "10,000 soldiers" to pay the debt.

The winning player, whether the attacker or the defender, can then collect all the Soldier game card(s) 205, Base game cards 215, and/or Area game cards 300 until the debt has been paid in full and can place the Soldier game cards 205 and/or Bases game cards 215 in their Soldier Stack 250. If the attack was initiated as an attack using the full set 340 and any accompanying Soldier game cards 205 and/or Base game cards 215, the winning player can claim everything in the full set 340 and place them as a full set 340 on the playing surface, such as in front of the winning player.

It is to be noted that if the winning player moves the Soldier game cards 205 and/or the Base games cards 215 elsewhere, each move counts as one of that player's three moves per turn. If the winning player collects a single Area 305 or an incomplete set 335 that the winning party does not have any cards for, the winning party can place the single Area 305 or the incomplete set 335 on the playing surface, such as in front of the winning player, separately, such as in its own column. Doing this, however, does not count as one of the three moves per turn.

After the initiating player completes his/her turn, the game 110 continues, such as in a clockwise rotation of play, to the next player, as well as each subsequent player after him/her in a similar fashion. Each subsequent player can then select a first move, a second move, and a third move from the plurality of moves in a similar fashion as the initiating player until one player collects the predetermined number of groups 350.

It should be understood that the war game is playable in an electronic or partially electronic manner using a terminal, such as a personal computer, microcomputer, minicomputer, mainframe computer, or other device having a processor and display, such as an electronic hand-held game device, for which representative images of cards, attack force values, and/or other related information are displayed on a screen via a graphical user interface (GUI). The game is also playable in conjunction with performance of selected functions on a network, such as the Internet or an intranet or using, for example, including use with other variations of play amenable to the type of machine and preferences or limitations for that machine.

Accordingly, a computer-assisted method for playing the war game via a processing device is provided. The method can include dealing, via the processing device, a plurality of cards from a set of war game cards to each of a group of at least two players, such that each player has a player hand of war game cards; designating a player to initiate the game; providing via the processing device, a dice to the designated player; identifying an attack force value for each player; the designated player selecting three moves from a plurality of authorized moves, the plurality of authorized moves comprising playing an Action game card, re-arranging Soldier or Base game cards, moving one of the plurality of Area game cards from a hand to be displayed to other players, and acquiring one or more cards from another player; moving rotation of play to a next player; and continuing play until one of the players collects one or more sets of the Area game cards, each set including Area game cards having the same area name.

It is to be understood that the present invention is not limited to the embodiments described above, but encompasses any and all embodiments within the scope of the following claims.

I claim:

1. Apparatus for playing a game of war using cards and dice, the apparatus comprising:

a plurality of game cards, including:

(a) a distinct first subset of game cards including a plurality of Soldier game cards, each of the plurality of Soldier game cards having one of a first set of numerical values displayed thereon, a plurality of Base game cards, each of the plurality of Base game cards having displayed thereon indicia associated with a type of armed force, and a plurality of Supply game cards, each of the plurality of Supply game cards having displayed thereon indicia associated with an area, (b) a distinct second subset of game cards including a plurality of Area game cards, each of the plurality of Area game cards having displayed thereon indicia associated with an area and one of a second set of numerical values, and (c) a distinct third subset of game cards including a plurality of Action game cards, each of the plurality of Action game cards having displayed thereon indicia representing an action a player can take with respect to an opponent;

at least one attacker dice having a plurality of faces, each of the faces having a distinct identifiable indicia displayed thereon; and at least one defender dice having a plurality of faces, each of the faces having a distinct identifiable indicia displayed thereon.

2. The apparatus for playing a game of war using cards and dice according to claim 1, wherein the plurality of war game cards comprises 140 game cards.

3. The apparatus for playing a game of war using cards and dice according to claim 1, wherein the first set of numerical values includes 1,000, 5,000, and 10,000.

4. The apparatus for playing a game of war using cards and dice according to claim 1, wherein the second set of numerical values includes 1,000, 2,000, and 3,000.

5. The apparatus for playing a game of war using cards and dice according to claim 1, wherein the indicia associated with a type of armed force is selected from a group consisting of an image of a tank, an image of an airplane, and an image of a boat.

6. The apparatus for playing a game of war using cards and dice according to claim 1, wherein the indicia associated with an area includes an image of an Area flag.

7. The apparatus for playing a game of war using cards and dice according to claim 1, wherein the Area game card further comprises a group area designation, a plurality of symbols representing potential targets, a first supply value, and a second supply value.

8. The apparatus for playing a game of war using cards and dice according to claim 1, wherein the Action game card includes figures and instructions.

9. The apparatus for playing a game of war using cards and dice according to claim 1, wherein the at least one attacker dice has a color that is different from the at least one defender dice.

10. A computer-assisted method for playing a war game, comprising the steps of:

(a) providing via a processing device a set of war game cards, including:

(1) a distinct first subset of game cards including a plurality of Soldier game cards, each of the plurality of Soldier game cards having one of a first set of numerical values displayed thereon, a plurality of Base game cards, each of the plurality of Base game cards having displayed thereon indicia associated with a type of armed force, and a plurality of Supply game cards, each of the plurality of Supply game cards having displayed thereon indicia associated with an area, (2) a distinct second subset of game cards including a plurality of Area game cards, each of the plurality of Area game cards having displayed thereon indicia associated with an area and one of a second set of numerical values, and (3) a distinct third subset of game cards including a plurality of Action game cards, each of the plurality of Action game cards having displayed thereon indicia representing an action a player can take with respect to an opponent;

(b) providing at least one attacker dice and at least one defender dice, the attacker dice having at least one feature different from a feature of the defender dice;

(c) dealing the plurality of cards from a set of war game cards to each of a group of at least two players, such that each player has a player hand of war game cards;

(d) designating a player to initiate the game (e) providing via the processing device, a dice to the designated player;

(f) selectively determining a first move, a second move, and a third move, each move selected from a plurality of authorized moves consisting of selectively playing an Action game card, selectively re-arranging Soldier or Base game cards, selectively moving one of the plurality of Area game cards from a hand onto a playing surface, selectively withdrawing additional game cards from the withdrawing deck, and acquiring one or more cards from attacking another player;

(g) if the designated player chooses to attack another player at the Step (f), designating a player as an attacker and designating a player as a defender and proceed to Step (h), otherwise proceed to the Step (n);

(h) calculating an attack force value for the attacker, the attack force value being defined by the numerical value on at least one of the Area game card, the Soldier game card, and the Base game card;

(i) calculating a target attack force value, the target attack force value being less than or equal to the attack force value of the attacker (j) determining a first numerical value by rolling the attacker dice by the attacker;

(k) determining a second numerical value by rolling the defender dice by the defender;

(l) simultaneously comparing the first numerical value and the second numerical value;

(m) awarding the number of cards sufficient to account for the target attack force value to the player associated with the higher of the first numerical value and the second numerical value;

(n) determining if the designated player collects at least one set of the Area game cards, the collects at least one set of the Area game cards, including Area game cards having the same area name;

(o) determining a winner, if the designated player in the given turn collects the at least one set of the Area game cards, the designated player is the winner and the game is over, otherwise proceed to the Step (p);

(p) moving rotation of play to a next player; and (q) repeat steps (f) through (o).

* * * * *